US010603936B2

(12) United States Patent
Imaizumi et al.

(10) Patent No.: US 10,603,936 B2
(45) Date of Patent: Mar. 31, 2020

(54) PRINTER

(71) Applicant: Roland DG Corporation, Hamamatsu-shi, Shizuoka (JP)

(72) Inventors: Kiyomasa Imaizumi, Hamamatsu (JP); Kiyoshi Fujimoto, Hamamatsu (JP); Sachie Muroga, Hamamatsu (JP)

(73) Assignee: ROLAND DG CORPORATION, Shizuoka (JP)

( * ) Notice: Subject to any disclaimer, the term of this patent is extended or adjusted under 35 U.S.C. 154(b) by 0 days.

(21) Appl. No.: 16/015,254

(22) Filed: Jun. 22, 2018

(65) Prior Publication Data

US 2019/0001716 A1 Jan. 3, 2019

(30) Foreign Application Priority Data

Jun. 30, 2017 (JP) ..... 2017-129583

(51) Int. Cl.

| | |
|---|---|
| ***B41J 23/14*** | (2006.01) |
| ***B41J 19/20*** | (2006.01) |
| ***B41J 2/01*** | (2006.01) |
| ***B41J 25/00*** | (2006.01) |

(52) U.S. Cl.

CPC ..... *B41J 23/14* (2013.01); *B41J 2/01* (2013.01); *B41J 19/202* (2013.01); *B41J 25/006* (2013.01)

(58) Field of Classification Search

CPC ..... B41J 23/14; B41J 19/202

See application file for complete search history.

(56) References Cited

U.S. PATENT DOCUMENTS 4,401,990 A * 8/1983 Aiba ..... B41J 2/16535 347/32

2014/0146108 A1* 5/2014 Ebihara ..... B41J 29/13 347/19

FOREIGN PATENT DOCUMENTS

JP 2017-32698 A 2/2017

* cited by examiner

*Primary Examiner* — Jason S Uhlenhake

(74) *Attorney, Agent, or Firm* — Keating & Bennett, LLP

(57) ABSTRACT

A printer includes a carriage, a carriage moving mechanism including a motor, a motor driver that controls the motor, a stop instruction device, and an interlock device. The stop instruction device transmits a stop signal for the carriage or stops a driving permission signal for the carriage when a predetermined stop condition is satisfied. The interlock device is interposed between the motor and the motor driver and shuts off the motor from the motor driver after a lapse of a predetermined delay time of transmitting the stop signal or stopping the driving permission signal. The motor driver controls the motor to decelerate the carriage in at least a portion of a period before the delay time has elapsed.

8 Claims, 4 Drawing Sheets

PRINTER

CROSS REFERENCE TO RELATED APPLICATIONS

This application claims the benefit of priority to Japanese Patent Application No. 2017-129583 filed on Jun. 30, 2017. The entire contents of this application are hereby incorporated herein by reference.

BACKGROUND OF THE INVENTION

1. Field of the Invention

The present invention relates to a printer.

2. Description of the Related Art

Various devices used to date have employed an interlock operation of stopping a device with safety. Printers have also generally employed an interlock operation. Japanese Patent Application Publication No. 2017-32698, for example, discloses an image forming apparatus that stops power supply to an image forming unit when a cover of a housing is opened during printing.

An ink jet printer generally employs an interlock operation that stops traveling of a carriage and conveyance of a recording medium when a cover is opened. At this time, supply of electric power to a moving mechanism of the carriage and a conveying mechanism of the recording medium is stopped. Especially in a recent large-size printer, however, demands for increasing the speed and density of the printer have been increased, and to meet these demands, the size and weight of the carriage have increased. Accordingly, the carriage does not stop immediately after a stop operation in an interlock operation, and continues to travel for a while, or in some cases, might hit the inner side of the housing, disadvantageously. During the interlock operation, a power supply to the moving mechanism of the carriage is shut off, and thus, the carriage cannot be stopped by control. Thus, the carriage must be stopped by inertia. The stop by inertia cannot stop the carriage immediately unlike the stop by control, and thus, might cause problems such as hitting as described above.

SUMMARY OF THE INVENTION

Preferred embodiments of the present invention provide printers that each can stop a carriage in a short time in an interlock operation.

A printer according to a preferred embodiment of the present invention includes a carriage that is movable; a carriage moving mechanism that includes a motor and moves the carriage by driving of the motor; a motor driver that controls the motor; a stop instruction device that issues a stop signal for the carriage or stops a driving permission signal for the carriage when a predetermined stop condition is satisfied; and an interlock device that is interposed between the motor and the motor driver and shuts off the motor from the motor driver after a lapse of a predetermined delay time of transmitting the stop signal or stopping of the driving permission signal done by the stop instruction device, wherein the motor driver controls the motor to decelerate the carriage in at least a portion of a period before the delay time has elapsed.

In the printer described above, in a predetermined delay time after the stop signal is transmitted (or the driving permission signal is stopped), the motor that moves the carriage and the motor driver are still connected to each other. Thus, during the delay time, deceleration control of the carriage is able to be performed. The printer according to the present preferred embodiment is able to stop the carriage earlier than a printer which includes an interlock device to shut off a motor from a motor driver without a delay time, by performing the deceleration control of the carriage in at least a portion of the delay time.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
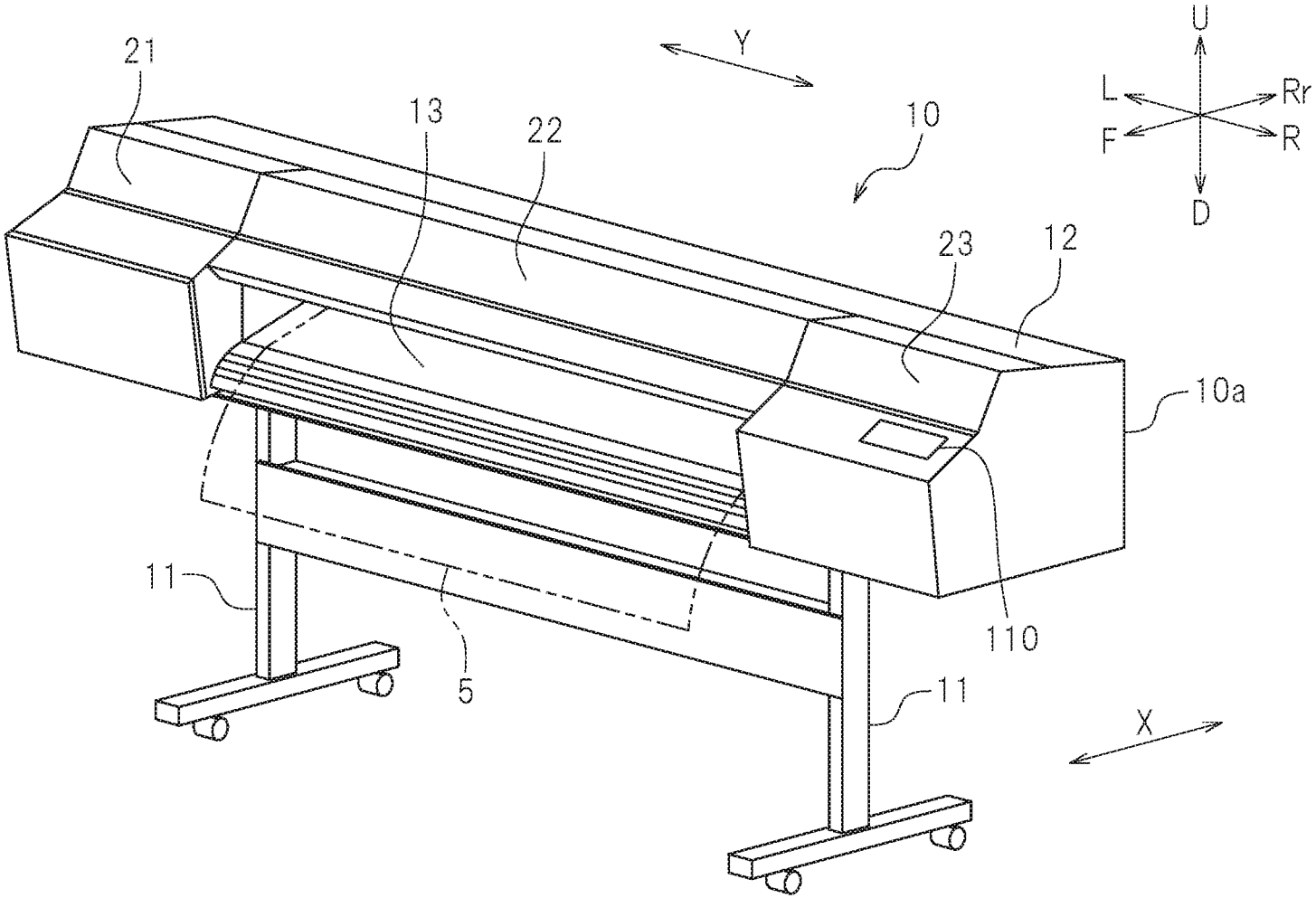
FIG. 1 is a perspective view of a printer according to a preferred embodiment of the present invention.

Printers according to preferred embodiments will be described with reference to the drawings. The preferred embodiments described here are, of course, not intended to particularly limit the present invention. Elements and features having the same functions are denoted by the same reference characters, and description for the same members and parts will not be repeated or will be simplified as appropriate. In the following description, with reference to a user in front of the printer, the direction from the printer toward the user is defined as forward, and the direction away from the user is defined as rearward. In the drawing, character Y represents a main scanning direction, and character X represents a subscanning direction X orthogonal to the main scanning direction Y. Characters F, Rr, L, R, U, and D in the drawings represent front, rear, left, right, up, and down, respectively. It should be noted that these directions are defined simply for convenience of description, and do not limit the state of installation of the printer, for example.

FIG. 1 is a perspective view of a large-size printer 10 according to a preferred embodiment of the present invention. The printer 10 is an ink jet printer that prints an image on the recording medium 5 by sequentially moving a rolled recording medium 5 and discharging ink from a plurality of ink heads H (see FIG. 2) mounted on a carriage 35 (see FIG. 2) that moves in the main scanning direction Y.

The recording medium 5 is a target on which an image is printed. The recording medium 5 is not limited to a specific medium. The recording medium 5 may be, for example, a paper sheet such as plain paper or ink jet printing paper, a transparent sheet of, for example, a resin or glass, or a sheet of, for example, a metal or rubber. The recording medium 5 may also be a fabric. The maximum size of the recording medium 5 that can be printed by the printer 10 according to this preferred embodiment is, for example, a roll sheet having a width of 1600 mm. However, this is merely one example, and the size of the printable recording medium 5 is not limited to a specific size.

As illustrated in FIG. 1, the printer 10 includes a printer body 10*a* and legs 11 supporting the printer body 10*a*. The printer body 10*a* extends in the main scanning direction Y. The printer body 10*a* includes a casing 12. Main components of the printer 10 are housed in the casing 12. A first cover 21, a second cover 22, and a third cover 23 are attached to the casing 12. The covers 21 through 23 are attached to the front side of the printer 10, and are able to be opened and closed in the top-bottom direction. The covers 21 through 23 are provided for maintenance of the inside of the casing 12, for example.

Figure 2:
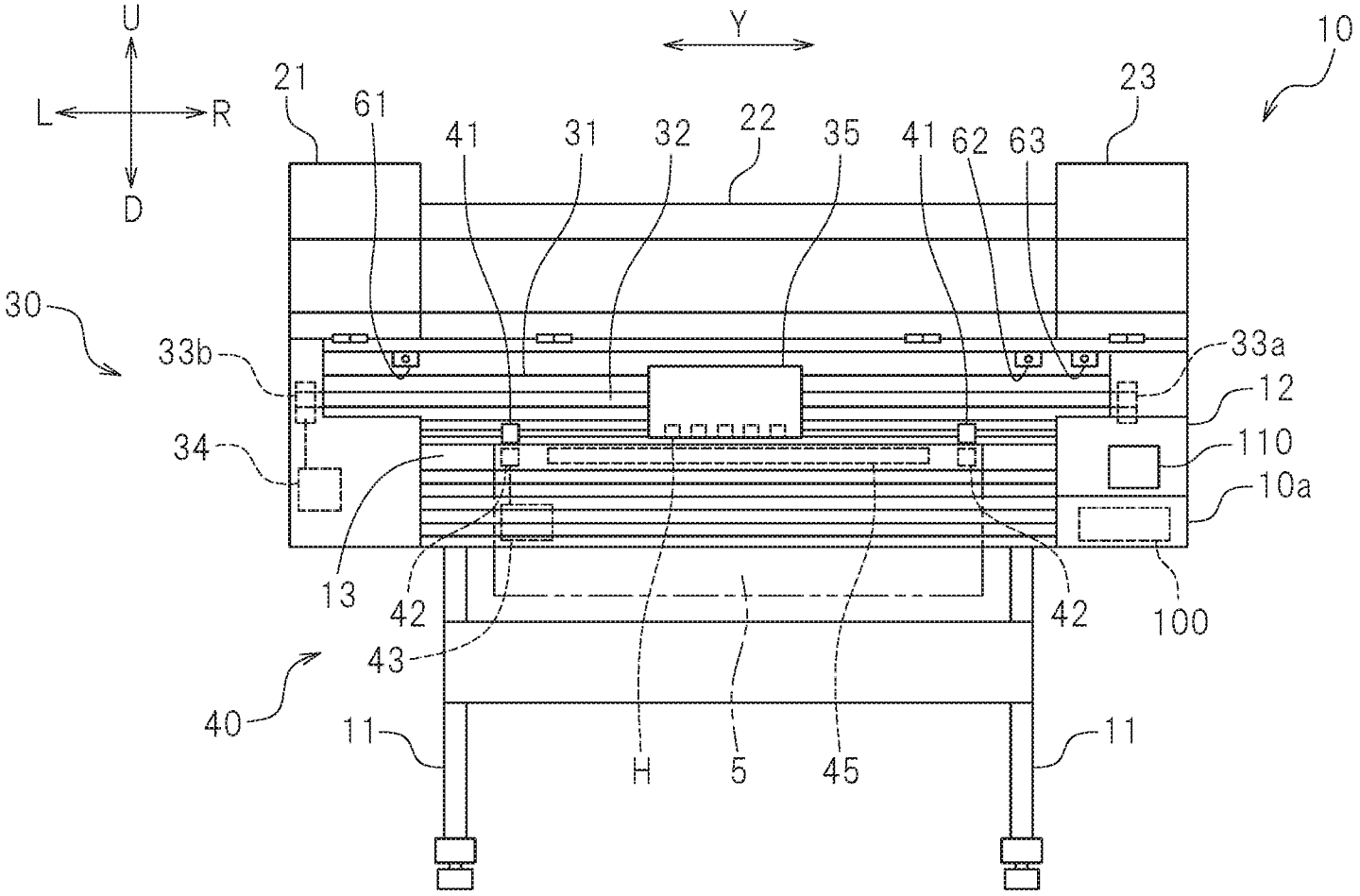
FIG. 2 is a front view of the printer in a state in which covers are open.

FIG. 2 is a front view of the printer 10 in a state in which the covers 21 through 23 are open. As illustrated in FIG. 2, the printer body 10*a* includes, inside the casing 12, a guide rail 31 and the carriage 35 engaged with the guide rail 31. The guide rail 31 extends in the main scanning direction Y. The guide rail 31 guides movement of the carriage 35 in the main scanning direction Y. An endless belt 32 is fixed to the carriage 35. The belt 32 is wound around a pulley 33*a* at the right of the guide rail 31 and a pulley 33*b* at the left of the guide rail 31. A carriage motor 34 is attached to the left pulley 33*b*. The carriage motor 34 is electrically connected to a controller 100. The carriage motor 34 is controlled by the controller 100. When the carriage motor 34 is driven, the pulley 33*b* rotates so that the belt 32 runs. Accordingly, the carriage 35 moves in the main scanning direction Y along the guide rail 31. In this manner, the movement of the carriage 35 in the main scanning direction Y causes the ink heads H to move in the main scanning direction Y. In this preferred embodiment, the belt 32, the pulley 33*a*, the pulley 33*b*, and the carriage motor 34 are examples of a carriage moving mechanism 30 that moves the carriage 35 and the ink heads H mounted on the carriage 35 in the main scanning direction Y.

A platen 13 is disposed below the carriage 35. The platen 13 extends in the main scanning direction Y. The recording medium 5 is placed on the platen 13. Pinching rollers 41 that press the top of the platen 13 downward are disposed above the recording medium 5. The pinching rollers 41 are disposed behind the carriage 35. The platen 13 is provided with grit rollers 42. The grit rollers 42 are disposed below the pinching rollers 41. The grit rollers 42 are disposed at positions facing the pinching rollers 41. The grit rollers 42 are coupled to a feed motor 43. The grit rollers 42 are rotatable by a driving force of the feed motor 43. The feed motor 43 is electrically connected to the controller 100. The feed motor 43 is controlled by the controller 100. When the grit rollers 42 rotate with the recording medium 5 sandwiched between the pinching rollers 41 and the grit rollers 42, the recording medium 5 is conveyed in the subscanning direction X. In this preferred embodiment, the pinching rollers 41, the grit rollers 42, and the feed motor 43 are examples of a conveying mechanism 40 that conveys the recording medium 5 in the subscanning direction X. The conveying mechanism 40 and the carriage moving mechanism 30 define a moving mechanism that causes the recording medium 5 and the carriage 35 to move relative to each other.

The plurality of ink heads H are mounted on the carriage 35. The plurality of ink heads H are arranged in the main scanning direction Y on the carriage 35. Each of the plurality of ink heads H includes a plurality of nozzles (not shown) arranged in the subscanning direction X. The nozzles are arranged in the subscanning direction X to define a nozzle row. The number of nozzles is, for example, 300 in each nozzle row. This number is, of course, one example, and the number of nozzles belonging to one nozzle row is not limited to a specific number. Each of the ink heads H may include a plurality of nozzle rows. The nozzles in the ink heads H are not limited to a specific arrangement.

Actuators (not shown) including, for example, piezoelectric elements, are disposed inside the ink heads H. The actuators are electrically connected to the controller 100. The actuators are controlled by the controller 100. When the actuators are driven, ink is discharged from the nozzles of the ink heads H toward the recording medium 5.

The plurality of ink heads H communicate with unillustrated ink cartridges through unillustrated ink supply paths. The ink cartridges are detachably disposed at the right end of the printer body 10*a*, for example. One ink cartridge is prepared for each nozzle row. Each ink cartridge stores an ink of a process color such as CMYK or an ink of a spot color, for example. The nozzles of one nozzle row discharge an ink of the ink cartridge connected to this nozzle row. All the plurality of nozzle rows may discharge inks of different colors from the nozzles. Alternatively, some of the nozzle rows may discharge an ink of the same color from the nozzle. Inks discharged from the nozzles of the nozzle rows are not limited to specific types. The inks are not limited to specific materials, either, and various materials conventionally used as ink materials for ink jet printers may be used. Examples of the inks include a solvent-based pigment ink, an aqueous pigment ink, an aqueous dye ink, and an ultraviolet ray curing pigment ink that is cured by ultraviolet radiation.

As illustrated in FIG. 2, the printer 10 includes a heater 45. The heater 45 is disposed below the platen 13. The heater 45 is disposed ahead of the grit rollers 42. The heater 45 heats the platen 13. When the platen 13 is heated, the recording medium 5 disposed on the platen 13 and ink attached to the recording medium 5 are heated so that drying of the ink is promoted. The heater 45 is electrically connected to the controller 100. The heating temperature of the heater 45 is controlled by the controller 100.

As illustrated in FIG. 2, switches 61 through 63 that detect open/close states of the covers 21 through 23 are disposed in the casing 12. Specifically, the open/close state of the first cover 21 is detected by the first switch 61. The open/close state of the second cover 22 is detected by the second switch 62. The open/close state of the third cover 23 is detected by the third switch 63. The first switch 61 is, for example, a mechanical limit switch. A mechanical contact point is disposed in the first switch 61 and is connected by a depression of a movable portion of the switch. The movable portion of the first switch 61 is depressed by the first cover 21 when the first cover 21 is closed. In the following description, regarding contact points, such a closed state will be referred to as "on" when necessary. On the other hand, a state in which the contact point is open will be referred to as "off." Thus, the first switch 61 is turned on when the first cover 21 is closed. The second switch 62 and the third switch 63 are similar mechanical switches. In a manner similar to the first switch 61, the second switch 62 is turned on when the second cover 22 is closed, and the third switch 63 is turned on when the third cover 23 is closed.

As illustrated in FIG. 2, an operation panel 110 is disposed at the right end of the printer body 10*a*. The operation panel 110 includes a display screen that displays a device status and entry keys that are operated by a user, for example. The controller 100 that controls various operations of the printer 10 is housed in the operation panel 110. The controller 100 is connected to the feed motor 43, the heater 45, and actuators of the ink heads H so that the controller 100 can communicate with these devices, and is configured or programmed to control the devices. The controller 100 is connected to the carriage motor 34 through a motor driver 52 (see FIG. 3) and is configured or programmed to control the carriage motor 34 and the motor driver 52. The controller 100 includes a scanning controller 101 that controls driving of the carriage motor 34 and a signal receiver 102 (see FIG. 3 for each) that receives an "open detection signal" from a detection circuit 60 when the first through third covers are opened. Specifically, when the first cover 21 is opened, the signal receiver 102 receives an open detection signal S1 of the first cover (see FIG. 3). The signal receiver 102 receives an open detection signal S2 (see FIG. 3) of the second cover when the second cover 22 is opened, and receives an open detection signal S3 of the third cover when the third cover 23 is opened (see FIG. 3). When any one of the open detection signals S1, S2, and S3 of the covers is received during traveling of the carriage 35, the scanning controller 101 transmits a signal of instructing deceleration stop of the carriage motor 34 to the motor driver 52. The controller 100 includes other components such as controllers configured or programmed to control operations of the feed motor 43, the heater 45, and the actuators of the ink heads H, and these controllers are not described in this preferred embodiment.

The controller 100 is not limited to a specific configuration. The controller 100 is, for example, a microcomputer. The microcomputer is not limited to a specific hardware configuration, and includes, for example, an interface (I/F) that receives print data or others from an external device such as a host computer, a central processing unit (CPU) that executes an instruction of a control program(s), a read only memory (ROM) that stores a program(s) to be executed by the CPU, a random access memory (RAM) that is used as a working area in which the program(s) is expanded, and a storage such as a memory that stores the program and various types of data. The controller 100 does not need to be disposed inside the printer body 10*a*, and may be, for example, a computer disposed outside the printer body 10*a* and communicably connected to the printer body 10*a* by wires or wirelessly.

The controller 100 controls the carriage motor 34 to run the carriage 35 in the main scanning direction Y and controls the actuators of the ink heads H to discharge ink from the nozzles, thus performing printing on the recording medium 5. When printing of one scanning line is completed, the controller 100 drives the feed motor 43 so that the recording medium 5 moves forward. Printing for one scanning line on the recording medium 5 is completed by one or a plurality of scans with the carriage 35.

Figure 3:
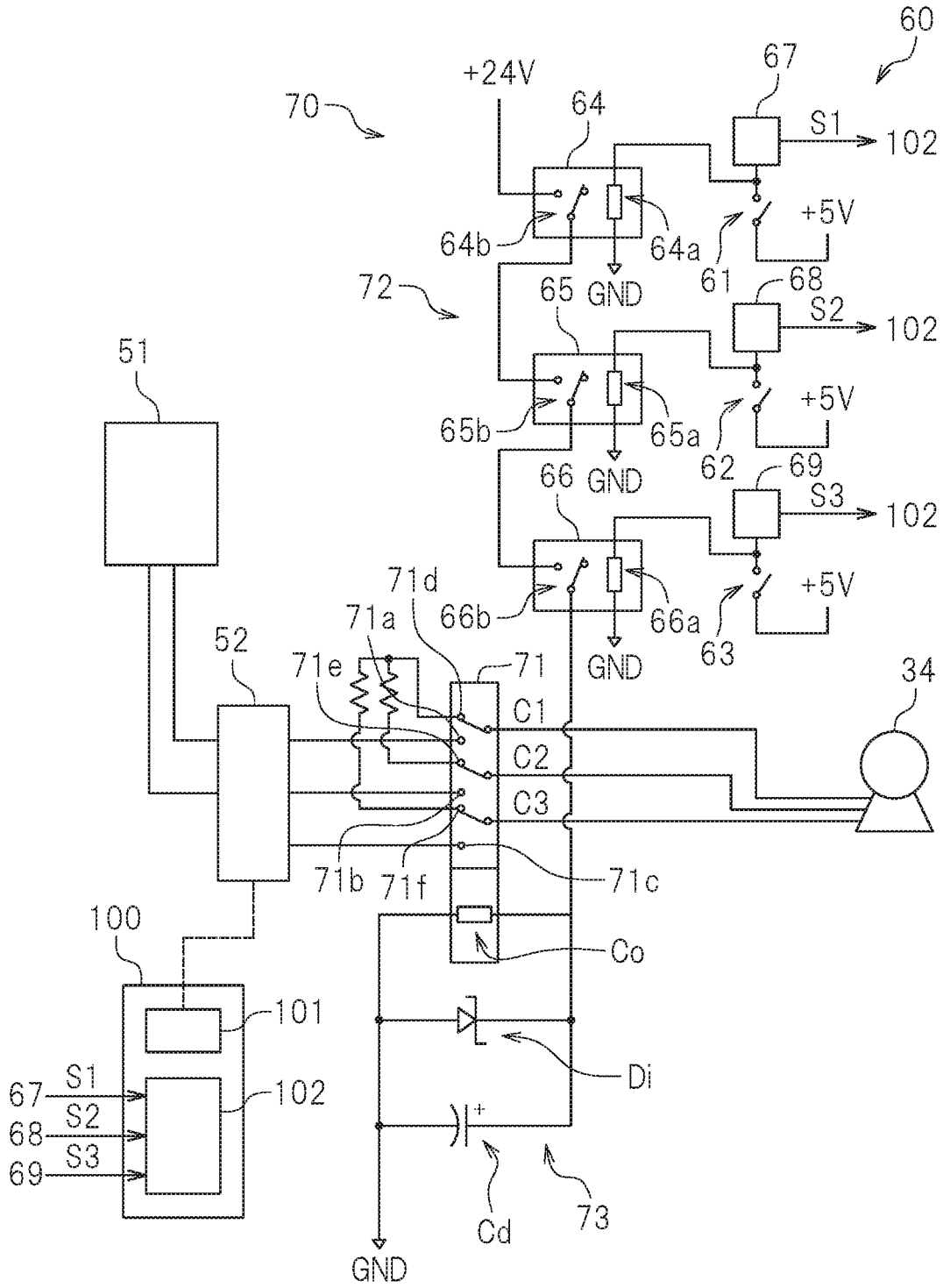
FIG. 3 is a circuit diagram regarding control of a carriage motor.

FIG. 3 is a circuit diagram regarding control of the carriage motor 34. The circuit regarding control of the carriage motor 34 includes an operation system and an interlock system. The operation system is a system from the power supply 51 to the carriage motor 34 through the motor driver 52. Driving of the carriage motor 34 is controlled by the scanning controller 101 of the controller 100 through the motor driver 52. A control signal to control driving, stopping, the speed, the rotation direction, and so forth of the carriage motor 34 is transmitted from the motor driver 52 to the carriage motor 34. Although not shown, the power supply 51 is connected to a commercial power supply, for example, and supplies electric power conforming to a predetermined power supply specification to the devices including the motor driver 52.

A main relay 71 is interposed between the motor driver 52 and the carriage motor 34 in the operation system. The main relay 71 is an electromagnetic relay including three circuits and six contact points, for example. The main relay 71 is turned on when electric power is supplied to a coil Co and is turned off when the power supply is stopped. When the main relay 71 is on, three contact points C1, C2, and C3 connected to the carriage motor 34 are respectively connected to three contact points 71*a*, 71*b*, and 71*c* connected to the motor driver 52. That is, the motor driver 52 and the carriage motor 34 are connected to each other. On the other hand, when the main relay 71 is off, the three contact points C1, C2, and C3 connected to the carriage motor 34 are respectively connected to three contact points 71*d*, 71*e*, and 71*f*. At this time, as illustrated in FIG. 3, three lines that transfer a control signal to the carriage motor 34 are short-circuited to each other through resistors. The main relay 71 defines and functions as a point at which the operation system and the interlock system intersect each other.

The interlock system includes an interlock circuit 70 including the main relay 71 described above and a detection circuit 60. The detection circuit 60 issues a stop signal or stops a driving permission signal in a case where predetermined conditions to stop the carriage motor 34 are satisfied. In this preferred embodiment, the detection circuit 60 stops a driving permission signal of the carriage motor 34. The driving permission signal and a stop of this signal will be described later. In response to the stop of the driving permission signal, the interlock circuit 70 turns off the main relay 71. Accordingly, the carriage motor 34 is shut off from the motor driver 52. Although described in detail later, in the interlock operation described above, the main relay 71 is not turned off immediately. The main relay 71 is turned off after the motor driver 52 stops the carriage motor 34 by control (i.e., after the carriage 35 completely stops) based on an instruction of the scanning controller 101.

The detection circuit 60 includes the first switch 61, the second switch 62, and the third switch 63; the first coil 64*a*, the second coil 65*a*, and the third coil 66*a* respectively connected to the first through third switches 61 through 63; and a first electronic switch 67, a second electronic switch 68, and a third electronic switch 69 also respectively connected to the first through third switches 61 through 63. The power supply line of the detection circuit 60 is at a DC voltage of about 5 V, for example. A contact point of the first switch 61, a contact point of the second switch 62, and a contact point of the third switch 63 are connected to the first coil 64*a*, the second coil 65*a*, and the third coil 66*a*, respectively, and define excitation circuits. When excited, the first coil 64*a*, the second coil 65*a*, and the third coil 66*a* connect the contact point 64*b* of the first relay 64, the contact point 65*b* of the second relay 65, and the contact point 66*b* of the third relay 66, respectively. A state in which all the coils 64*a*, 65*a*, and 66*a* are energized and excited corresponds to a state in which a "driving permission signal" is issued in this preferred embodiment. That is, a state in which the first switch 61, the second switch 62, and the third switch 63 are depressed by the first cover 21, the second cover 22, and the third cover 23 and the excitation circuits of the coil 64*a* of the first relay 64, the coil 65*a* of the second relay 65, and the coil 66*a* of the third relay 66 are on is a state of normal printing in which the "driving permission signal" is issued. In contrast, in this configuration, if at least one of the first switch 61, the second switch 62, and the third switch 63 is off, the detection circuit 60 is not turned on. Disconnection of this detection circuit 60 corresponds to a "stop of the driving permission signal" in this preferred embodiment.

A method for stopping the driving permission signal at the stop of an interlock operation is a method generally used in terms of safety. It should be noted that the example described above is merely one preferred embodiment, and is not intended to exclude an example in which a stop signal is issued in the interlock operation.

The first electronic switch 67, the second electronic switch 68, and the third electronic switch 69 transmit a "cover open detection signal" to the signal receiver 102 of the controller 100 when the first switch 61, the second switch 62, and the third switch 63, respectively, are disconnected. More specifically, the first electronic switch 67 transmits an open detection signal S1 of the first cover 21 to the signal receiver 102, the second electronic switch 68 transmits an open detection signal S2 of the second cover 22 to the signal receiver 102, and the third electronic switch 68 transmits an open detection signal S3 of the third cover 23 to the signal receiver 102.

The interlock circuit 70 includes the main relay 71, a relay control circuit 72, and a delay circuit 73. A power supply line of the interlock circuit 70 is at a DC voltage of about 24 V, for example. The relay control circuit 72 controls on and off of the main relay 71. The relay control circuit 72 is connected to the coil Co of the main relay 71, and in connecting the carriage motor 34 and the motor driver 52 to each other, supplies electric power to the coil Co, and when the driving permission signal is stopped, stops the power supply to the coil Co, to control on and off of the main relay 71. The relay control circuit 72 includes the contact point 64*b* of the first relay 64, the contact point 65*b* of the second relay 65, and the contact point 66*b* of the third relay 66. The contact points 64*b*, 65*b*, and 66*b* are connected together in series. Thus, when all of the first switch 61, the second switch 62, and the third switch 63 are turned on, the relay control circuit 72 is connected. In contrast, when at least one of the first switch 61, the second switch 62, and the third switch 63 is off, the relay control circuit 72 is not connected. When all the contact point 64*b* of the first relay 64, the contact point 65*b* of the second relay 65, and the contact point 66*b* of the third relay 66 are on, a DC voltage of about 24 V is supplied to the coil Co of the main relay 71. When the coil Co is energized, the main relay 71 is turned on, and the contact points 71*a*, 71*b*, and 71*c* of the main relay 71 to the motor driver 52 are respectively connected to the contact points C1, C2, and C3 to the carriage motor 34. Consequently, the carriage motor 34 and the motor driver 52 are connected to each other. On the other hand, when at least one of the contact point 64*b* of the first relay 64, the contact point 65*b* of the second relay 65, and the contact point 66*b* of the third relay 66 is off, supply of a DC voltage of about 24 V to the coil Co is stopped. Operations of the components after the stop of supply of a DC voltage of about 24 V to the coil Co will be described.

The delay circuit 73 is connected to the coil Co. The delay circuit 73 includes a capacitor Cd connected in parallel to the coil Co. The capacitor Cd has a large capacitance of about 1000 μF, for example. The delay circuit 73 is a circuit that supplies electric power to the coil Co for a while after one of the switches 61 through 63 is turned off and supply of a DC voltage of about 24 V to the coil Co is stopped.

When all the first switch 61, the second switch 62, and the third switch 63 are on and a DC voltage of about 24 V is supplied to the coil Co, a DC voltage of about 24 V is also applied to the delay circuit 73 connected in parallel to the coil Co. At this time, the capacitor Cd is charged in accordance with the capacitance. When at least one of the first switch 61, the second switch 62, and the third switch 63 is turned off with the capacitor Cd being charged, no voltage is applied to the capacitor Cd any more, and the capacitor Cd starts discharging. During this discharge, a current due to the discharge flows in the coil Co. While the voltage at this time is greater than or equal to an operating voltage of the main relay 71, the main relay 71 is kept on.

A diode Di is also connected in parallel to the coil Co. As illustrated in FIG. 3, the diode Di is wired in the opposite direction to the DC voltage of about 24 V. That is, in a state in which the driving permission signal is issued, no current flows in the diode Di. However, when power supply to the coil Co is stopped, charges accumulated in the coil Co and charges supplied to the capacitor Cd are discharged through the diode Di.

The following description is directed to an interlock operation in a case where at least one of the covers 21 through 23 is opened in printing in the printer 10 according to this preferred embodiment, in comparison to the case of a conventional interlock operation. In a conventional printer, when one of the covers is opened in printing so that a close detection switch corresponding to this opened cover is turned off, for example, power supply to the motor driver is shut off from a power supply unit. Substantially at the same time as when power supply to the motor driver is shut off, a control signal from the motor driver to the carriage motor is not output any more. Thus, the carriage has to stop by inertia, and thus, travels some distance before stopping. In some types of motors, an electromagnetic braking is exerted. However, electromagnetic braking alone is not sufficient for a large-size carriage, and at some positions of the carriage when the interlock operation is performed, the carriage might hit the casing in the worst case. In addition, with the stopping of power supply from the power supply unit to the motor driver, an unexpected problem might occur in a circuit except the motor driver connected to the power supply unit. Thus, it is necessary to provide an additional safety circuit to avoid the problem.

Figure 4:
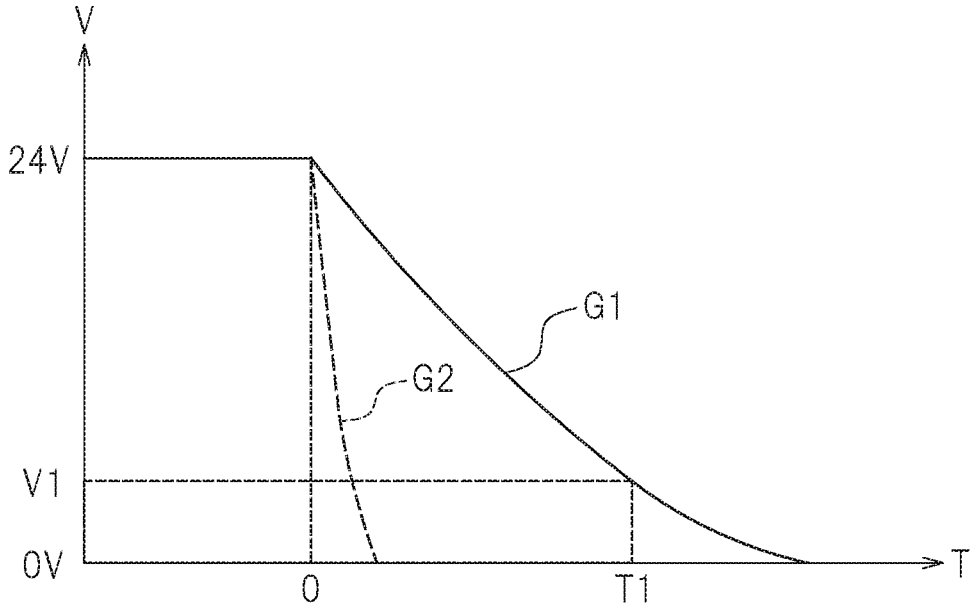
FIG. 4 is a diagram showing a change of a voltage applied to a coil of a main relay with time, and shows a comparison between a case including a delay circuit and a case including no delaying circuit.

On the other hand, the interlock circuit 70 according to this preferred embodiment does not shut off power supply from the power supply unit 51 to the motor driver 52. Accordingly, in an interlock operation, the power supply unit 51 also continues to supply electric power to the motor driver 52. In addition, the interlock circuit 70 according to this preferred embodiment includes the delay circuit 73 connected to the coil Co of the main relay 71. The delay circuit 73 enables the interlock circuit 70 to maintain connection of the motor driver 52 to the carriage motor 34 for a certain period of time. For example, here, suppose the first cover 21 is opened so that the first switch 61 is turned off during traveling of the carriage 35. Then, the detection circuit 60 and subsequently the relay control circuit 72 are turned off so that power supply from the power supply to the coil Co of the main relay 71 is stopped. In the printer 10 according to this preferred embodiment, however, even in this case, the delay circuit 73 can maintain connection between the motor driver 52 and the carriage motor 34 for a certain period of time. FIG. 4 is a diagram showing a change of a voltage V applied to the coil Co with time, and shows a comparison between a case including the delay circuit 73 and a case not including the delay circuit 73. In FIG. 4, the ordinate represents a voltage V applied to the coil Co. In FIG. 4, V1 is a threshold at which connection between the contact points C1, C2, and C3 and the contact points 71*a*, 71*b*, and 71*c* can be maintained in the main relay 71. In FIG. 4, the abscissa represents a time T that has elapsed since the first switch 61 was opened. The time at which the time T is "0 (zero)" represents the time when the first switch 61 is opened. In FIG. 4, a graph G1 of a solid line represents a change of the voltage V with time in the printer 10 according to this preferred embodiment, and a graph G2 of a broken line represents a change of the voltage V with time in a case not including the delay circuit 73. As shown in FIG. 4, in the case not including the delay circuit 73, the voltage V applied to the coil Co becomes 0 V substantially at the same time as opening of the first switch 61. On the other hand, in the printer 10 according to this preferred embodiment, the voltage V applied to the coil Co drops in a curve from about 24 V, and when discharge of the capacitor Cd is finished, the voltage V becomes 0 V.

A period of time in which power supply to the carriage motor 34 can be maintained is determined based on a capacitance of the capacitor Cd. As the capacitance increases, the time required for full discharging increases, whereas as the capacitance decreases, the discharging time decreases. According to FIG. 4, as the capacitance increases, the gradient of a descending curve of the voltage V becomes gentler, whereas as the capacitance decreases, the gradient of a descending curve of the voltage V becomes steeper. In this preferred embodiment, the on-state of the main relay 71 is maintained until a time T1 when the voltage applied to the coil Co decreases below a threshold V1. Since the threshold V1 is determined based on the main relay 71, as the capacitance of the capacitor Cd increases, the time T1 when the carriage motor 34 and the motor driver 52 are connected to each other becomes later, and as the capacitance decreases, the time T1 when the carriage motor 34 and the motor driver 52 are connected to each other becomes earlier.

When the first switch 61 is turned off, the first electronic switch 67 of the detection circuit 60 transmits the open detection signal S1 of the first cover 21. The open detection signal S1 of the first cover 21 is received by signal receiver 102 of the controller 100. When the signal receiver 102 receives the open detection signal of one or more of the open detection signals S1, S2, and S3, the scanning controller 101 instructs the motor driver 52 to decelerate and stop the carriage motor 34. At this time, the main relay 71 is still on and the motor driver 52 is connected to the carriage motor 34, and thus, the carriage motor 34 is able to be decelerated by control. In some states of the present preferred embodiment, the carriage 35 does not need to be completely stopped during the delay, but in this preferred embodiment, the carriage 35 is completely stopped. The method of completely stopping the carriage 35 by deceleration control as shown in this preferred embodiment has more reliability than a method of stopping by inertia lastly.

Figure 5:
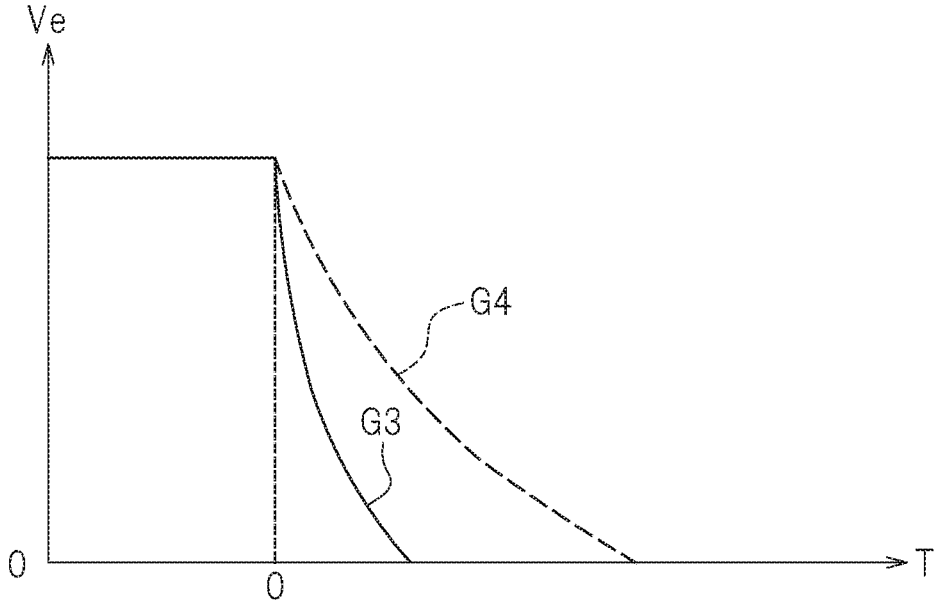
FIG. 5 is a diagram showing a change of the velocity of the carriage with time, and shows a comparison between the case of stop by control and the case of stop by inertia.

FIG. 5 is a diagram showing a change of the velocity of the carriage 35 with time, and shows a comparison between the case of stop by control and the case of stop by inertia. In FIG. 5, the abscissa represents a time T that has elapsed since the first switch 61 is opened. In a manner similar to FIG. 4, the time at which the time T is "0 (zero)" represents the time when the first switch 61 is opened. The ordinate in FIG. 5 represents a velocity Ve of the carriage 35. In FIG. 5, a graph G3 of a solid line represents a change of the velocity Ve of the carriage 35 with time in the printer 10 according to this preferred embodiment, and a graph G4 of a broken line represents a change of the velocity Ve of the carriage 35 with time in a case where stop by inertia is performed instead of stop by control. As shown in FIG. 5, the decrease in the velocity of the carriage 35 that is being stopped by control (indicated by the graph G3 of the solid line) is stopped earlier than the decrease in the velocity of the carriage 35 that is being stopped by inertia (indicated by the graph G4 of the broken line). The state in which the velocity Ve becomes "0 (zero)" is a complete stop of the carriage. The lower areas (areas each obtained by integrating the velocity Ve by the time T) of the graphs G3 and G4 after time "0" represent the traveling distances of the carriage 35 in the case of stop by control and the case of stop by inertia, respectively. FIG. 5 demonstrates that the traveling distance derived by stop by control and represented by the graph G3 is shorter than that derived by stop by inertia and represented by the graph G4.

The duration of the time required for a complete stop depends on the weight and velocity of the carriage 35. According to the findings and discoveries of the inventors of preferred embodiments of the present invention, in a printer in which a carriage has a weight of about 6 kg and a maximum velocity of about 1.4 m/s, the time required for stopping the carriage even in a high-speed operation is at least about 100 ms or more. More preferably, the time required for complete stopping is about 200 ms or more. To obtain this, the capacitor Cd preferably has a capacitance of about 100 μF to about 1000 μF. This is, of course, a preferred example, and the present invention is not limited to this example.

In the manner described above, the interlock circuit 70 according to the present preferred embodiment includes the delay circuit 73, and can stop the carriage 35 by deceleration while a connection between the carriage motor 34 and the motor driver 52 is maintained by the delay circuit 73. After the carriage 35 is completely stopped safely, the carriage motor 34 can be shut off from the motor driver 52. Based on the findings and discoveries of the inventors of preferred embodiments of the present invention, the delay time required for complete stopping of the carriage 35 is about 100 ms or more, for example.

The delay circuit 73 preferably includes a circuit including the capacitor Cd. The delay circuit 73 including the capacitor Cd is simple, and thus, is easily fabricated. In addition, since the delay circuit 73 is not defined by software but by hardware, the delaying circuit 73 has high reliability as an interlock device. The capacitance of the capacitor Cd to reliably stop the carriage 35 is preferably about 100 μF to about 1000 μF, for example.

The interlock circuit 70 according to the present preferred embodiment does not stop power supply from the power supply unit 51 to the motor driver 52 even in an interlock operation. Thus, power supply from the power supply unit 51 to the motor driver 52 is also maintained in the interlock operation. Accordingly, it is unnecessary to provide an additional safety circuit for a case where power supply to the motor driver 52 is stopped.

It is dangerous to open a cover during traveling of the carriage 35, and thus, the function of stopping the carriage 35 by control is effective especially for a printer including a cover that can be opened and closed as shown in the present preferred embodiment.

The configuration of the circuit illustrated in FIG. 3 is an example, and preferred embodiments of the present invention are not limited to this example. The interlock circuit is basically preferably defined by hardware, but may be partially defined by software. The types of devices to be used are not limited to a mechanical switch and a contact point relay, for example.

The foregoing description is directed to the preferred embodiments of the present invention. The preferred embodiments described above, however, are merely examples, and the present invention is able to be implemented in various other preferred embodiments and modifications thereto.

For example, in the preferred embodiments described above, conditions to execute an interlock operation include a condition that at least one of the covers 21 through 23 is opened during traveling of the carriage 35, but may include other conditions. Interlock conditions may include a user operation such as depression of an emergency stop button, or may include abnormality detection of a portion of the printer 10. The techniques disclosed here are also effective for cases such as emergency stop or abnormality detection of a printer. For example, in a case where emergency stop is added to the interlock conditions, the detection circuit 60 is additionally provided with an emergency stop button, for example. When the emergency stop button is depressed, the detection circuit 60 is disconnected, and the driving permission signal is stopped. In addition, a signal indicating that an emergency stop operation is performed is transmitted by an electronic switch or another device to the signal receiver 102. Alternatively, an emergency stop signal may be transmitted to the controller 100 so that the controller 100 disconnects the detection circuit 60. Subsequent processes are the same as those described above. The techniques disclosed here may be applied to a stop of a member except the carriage 35.

In the preferred embodiments described above, the carriage 35 moves in the main scanning direction Y, and the recording medium 5 moves in the subscanning direction X. The present invention, however, is not limited to these examples. The carriage 35 and the recording medium 5 move relative to each other, and any one of the carriage 35 and the recording medium 5 may move in the main scanning direction Y or the subscanning direction X. For example, the recording medium 5 may not be movable and the carriage 35 may be movable in both of the main scanning direction Y and the subscanning direction X. Each of the carriage 35 and the recording medium 5 may be movable in both directions.

Ink discharge systems according to preferred embodiments of the present invention are not limited to a specific system. An ink discharge system of a printer according to a preferred embodiment of the present invention may be a piezoelectric system using a piezoelectric element, various continuous systems such as a binary deflection system or a continuous deflection system, or various on-demand systems such as a thermal system.

The techniques disclosed here are applicable to various types of printers. The techniques are similarly applicable to a so-called roll-to-roll printer that conveys a rolled recording medium 5 as described in the preferred embodiments, and also to an ink jet printer of a flat-bed type, for example. The printer 10 is not limited to a printer that is used alone as an independent printer, and may be combined with another device. For example, the printer 10 may be incorporated in another device. The techniques disclosed here are also applicable to a three-dimensional printer including a carriage, for example.

The terms and expressions used herein are for description only and are not to be interpreted in a limited sense. These terms and expressions should be recognized as not excluding any equivalents to the elements shown and described herein and as allowing any modification encompassed in the scope of the claims. The present invention may be embodied in many various forms. This disclosure should be regarded as providing preferred embodiments of the principles of the present invention. These preferred embodiments are provided with the understanding that they are not intended to limit the present invention to the preferred embodiments described in the specification and/or shown in the drawings. The present invention is not limited to the preferred embodiments described herein. The present invention encompasses any of preferred embodiments including equivalent elements, modifications, deletions, combinations, improvements and/or alterations which can be recognized by a person of ordinary skill in the art based on the disclosure. The elements of each claim should be interpreted broadly based on the terms used in the claim, and should not be limited to any of the preferred embodiments described in this specification or referred to during the prosecution of the present application.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A printer comprising:

a carriage that is movable;

a carriage moving mechanism that includes a motor and moves the carriage by driving of the motor;

a motor driver that controls the motor;

a stop instruction device that issues a stop signal for the carriage or stops a driving permission signal for the carriage when a predetermined stop condition is satisfied; and an interlock device that shuts off the motor from the motor driver after a lapse of a predetermined delay time of transmitting the stop signal or stopping the driving permission signal done by the stop instruction device; wherein the motor driver controls the motor to:

start decelerating the carriage in response to one of the following conditions being satisfied: (i) the stop signal being issued and transmitted, and (ii) the driving permission signal being stopped; and continue decelerating the carriage until the carriage has completely stopped or until the delay time has elapsed.

2. The printer according to claim 1, wherein the motor driver controls the motor to stop the carriage before the delay time has elapsed.

3. The printer according to claim 1, wherein the delay time is about 0.1 second or more.

4. The printer according to claim 1, wherein the interlock device includes:

a relay that includes an exciter and connects the motor and the motor driver to each other by power supply to the exciter;

a relay controller connected to the exciter, the relay controller being configured or programmed to supply electric power to the exciter in connecting the motor and the motor driver to each other and to stop supply of electric power to the exciter when the stop signal is issued or when the driving permission signal is stopped; and a delay circuit including a capacitor connected to the exciter to supply electric power to the exciter by discharge from the capacitor after the supply of electric power from the relay controller is stopped, and to delay shutting-off of the motor from the motor driver during the discharge.

5. The printer according to claim 4, wherein the capacitor has a capacitance of about 100 microfarad or more.

6. The printer according to claim 1, further comprising a power supply that supplies electric power to the motor driver, wherein the power supply maintains supply of electric power to the motor driver after the stop signal is issued or the driving permission signal is stopped.

7. The printer according to claim 1, further comprising:

a housing that houses the carriage; and a cover that opens and closes the housing; wherein the stop instruction device includes:

a detector that transmits a close signal when the cover is closed; and a receiver to receive the close signal from the detector, and when the close signal is interrupted during movement of the carriage, to issue the stop signal or stop the driving permission signal.

8. The printer according to claim 1, wherein the interlock device is interposed between the motor and the motor driver.

* * * * *